United States Patent [19]

Haustein

[11] Patent Number: 4,467,564

[45] Date of Patent: Aug. 28, 1984

[54] ARRANGEMENT OF A MEASUREMENT CONTROLLING DEVICE IN CIRCULAR GRINDING MACHINES

[75] Inventor: Manfred Haustein, Karl-Marx-Stadt, German Democratic Rep.

[73] Assignee: VEB Werkzeugmaschinenbau, Berlin, German Democratic Rep.

[21] Appl. No.: 278,120

[22] Filed: Jun. 29, 1981

[30] Foreign Application Priority Data

Jul. 10, 1980 [DD] German Democratic Rep. ... 222528

[51] Int. Cl.[3] ..... B24B 49/02

[52] U.S. Cl. ..... 51/165 R; 51/215 H; 51/236

[58] Field of Search ..... 51/165 R, 215 H, 49, 51/105 SP, 236 R; 33/178 R

[56] References Cited

U.S. PATENT DOCUMENTS

| | | | |
|---|---|---|---|
| 1,225,858 | 5/1917 | Raule | 51/49 UX |
| 3,065,577 | 11/1962 | Harris | 51/165 R |
| 3,123,943 | 3/1964 | Horsch | 51/165 R |
| 3,147,573 | 9/1964 | Flohr | 51/105 SP |
| 3,422,583 | 1/1969 | Stuckey | 51/49 |
| 3,664,066 | 5/1972 | Clark | 51/49 |
| 3,751,857 | 8/1973 | Price | 51/215 H |

*Primary Examiner*—Harold D. Whitehead
*Attorney, Agent, or Firm*—Jordan and Hamburg

[57] ABSTRACT

A measuring controlling device for a circular grinding machine including grinding means and workpiece retaining means for rotatably holding a workpiece to be ground comprises two measuring key devices and a measuring head for supporting the measuring key devices. The measuring key devices are located on a diametrical line extending through the central axis of the workpiece to be ground and are brought into contact with the outer surface of the workpiece therebetween. The measuring head is moved relative to the axial direction of the workpiece to be ground so that the measuring key devices can contact the entire outer surface of the workpiece. Consequently, the workpiece can be ground by means of the grinding means into a predetermined profile with reference to the actual profile measured by the measuring key devices.

3 Claims, 6 Drawing Figures

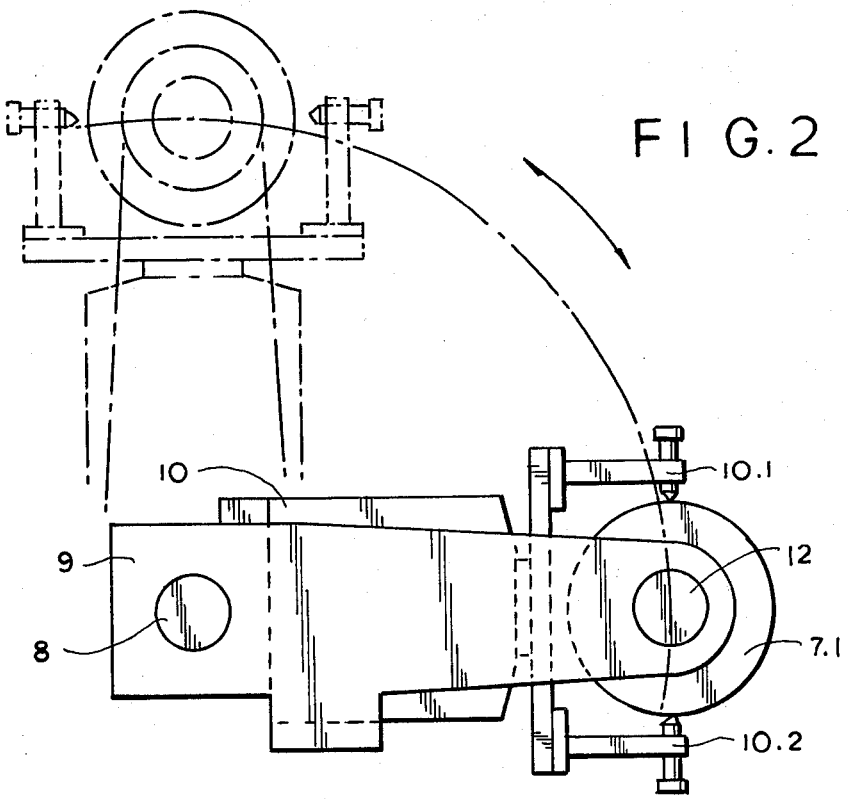
FIG. 2
FIG. 1
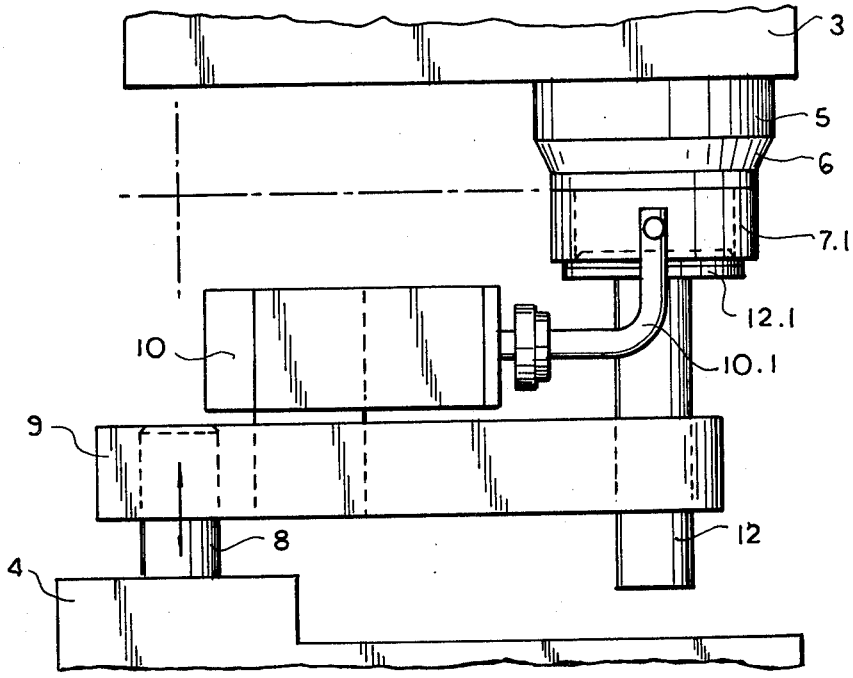

ARRANGEMENT OF A MEASUREMENT CONTROLLING DEVICE IN CIRCULAR GRINDING MACHINES

BACKGROUND OF THE INVENTION AND PRIOR ART STATEMENT

The invention relates to an arrangement of a measurement controlling device in circular grinding machines with a loading arrangement or an automatic workpiece shifting arrangement, which operates on the double-point measuring principle and is equipped with a liftable operator key, especially for measuring tracks of roller bearing rings of a variety of embodiments or other ring-shaped workpieces during their machining.

The ever-increasing quality requirements during recent years concerning precision of the geometrical shape of the tracks of roller bearings rings of a variety of embodiments or of other ring-shaped workpieces resulted in substitution of the previously used single-point measurement controlling devices with units which operate according to the double-point measuring principle in the corresponding circular grinding machines. The introduction of the double-point measuring heads resulted in an increased space requirement in the operating room of the machine as well as in increased time requirements since after completing each grinding process, the measuring head initially must be completely withdrawn from the operating area to make it possible to change the workpiece. The additional time required depends on the outer diameter of the workpieces. The additionally required retracting mechanism for in-and-out driving of the measuring head is arranged on the machine table so that its guiding pieces are constantly within the operating area of the machine, thus subjected to constant wear and tear. In addition, the operating room of the machine is limited by the presence of the retracting mechanism and can no longer be clearly visible. According to DE-OS No. 22 57 433, it has previously been attempted to cut the additional time requirement for driving out the measuring head. This embodiment provided that the dimension of the workpiece was compared with a predetermined value during the first step of the operating process, the dimension was no longer measured at the attainment of a predetermined relationship to the predetermined value, and thereafter, the machining of the workpiece proceeded until attainment of the finished measurement in a preprogrammed manner, at least depending upon the final measured dimensions. Here, the measuring head may be previously removed before termination of the machining period of the workpiece.

For this procedure, an additional electronic controlling circuit is necessary, which consists of a relationship circuit and a program circuit, wherein the program circuit includes a differentiator and is connected to a memory storage and to a signalling generator.

The disadvantage in this embodiment is that additional electronic controlling is necessary. Additionally, the grinding process cannot be controlled until the required measurement is attained, which could result in a lowering of quality. Furthermore, a retracting mechanism for the measuring head is necessary.

The object of the invention is to create conditions under which the advantages of the double-point measuring principle can be used and the previously mentioned disadvantages can be avoided.

The task of the invention is to create an advantageous arrangement for a measurement controlling device which operates according to the double-point measuring system for circular grinding machines which does not require additional electronic controlling and additional time for driving out the measuring head, ensuring excellent quality of measurement controlled grinding until attainment of the prescribed measurement. Moreover, the operating location of the machine should not be limited and no equipment which is subject to constant wear and tear by arrangement in the operating room should be employed. The operating capacity of the machine should not be restricted herein in any way.

SUMMARY OF THE INVENTION

The task is solved by hinging a measurement controlling device either directly on a feeding link or by means of a spring, in which power is derived in the operating position from a contact provided on the feeding link and, in the shifting position of the workpiece, from a contact provided on the workpiece spindle which, along with the measuring keys, is assembled in one plane. Here, the measurement controlling device may consist of two single-point measuring devices assembled on a crosspiece, opposite to each other. The feeding link on which the measurement controlling device is affixed may be a swinging arm or lifting element with superimposed axial movement. The crosspiece with the two single-point measuring devices may be assembled on a hinge joint with the shifting unit provided on the feeding link, in which the hinge joint is rigidly connected to the machine bed over a support.

The invention is explained in the following paragraphs by way of examples.

BRIEF DESCRIPTION OF THE DRAWINGS

In the corresponding drawings:

FIG. 1 illustrates a top view of an arrangement with direct fixation of a measuring head for straight tracks;

FIG. 2 illustrates a side view of FIG. 1 in the operating and workpiece shifting positions;

DETAILED DESCRIPTION OF PREFERRED EMBODIMENTS

Figure 4:
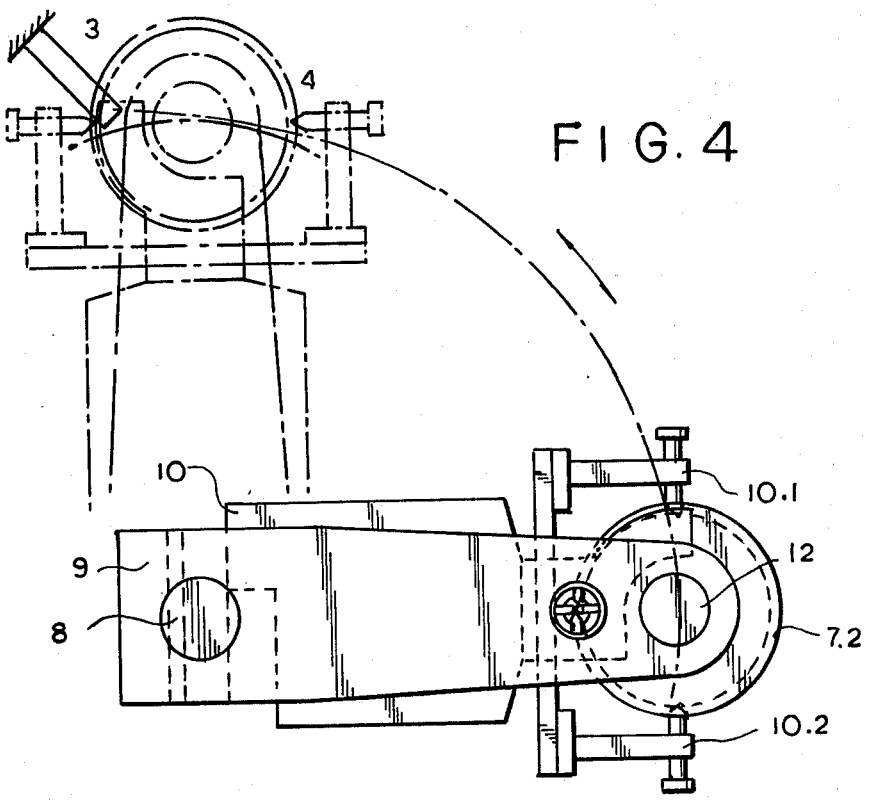
FIG. 4 illustrates a side view of FIG. 3 in the operating and workpiece shifting positions.
Figure 3:
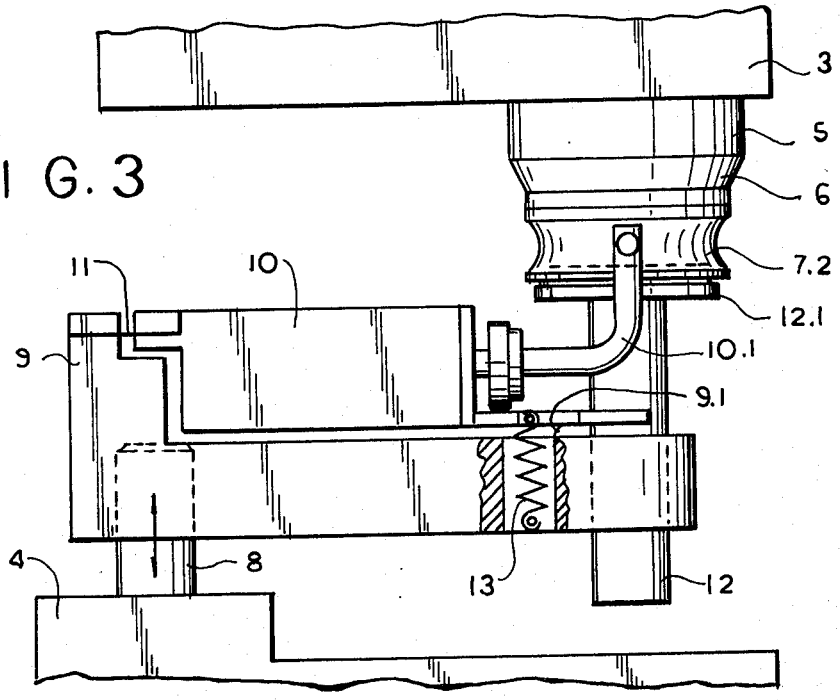
FIG. 3 illustrates a top view of an arrangement with a hinged measuring head for recessed tracks in an operating position.
Figure 5:
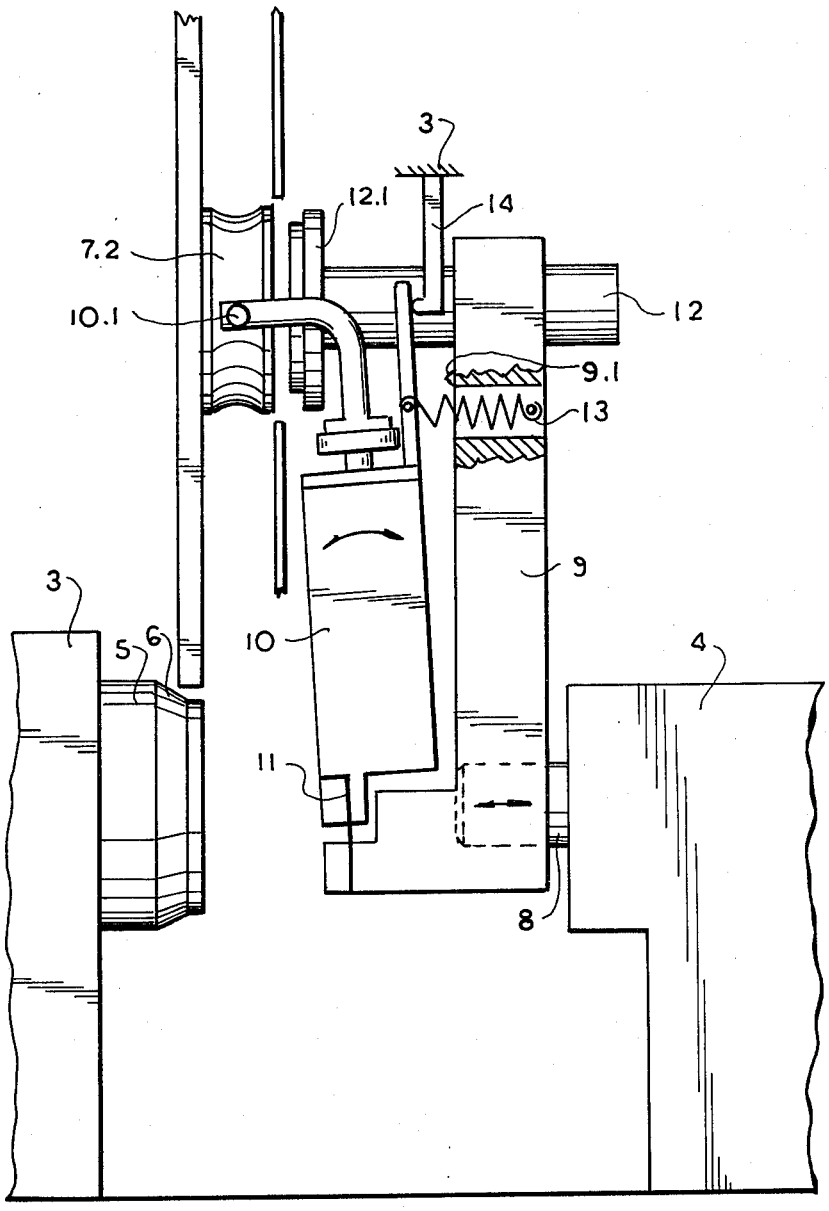
FIG. 5 illustrates a front view of FIG. 3, but in the workpiece shifting position.
Figure 6:
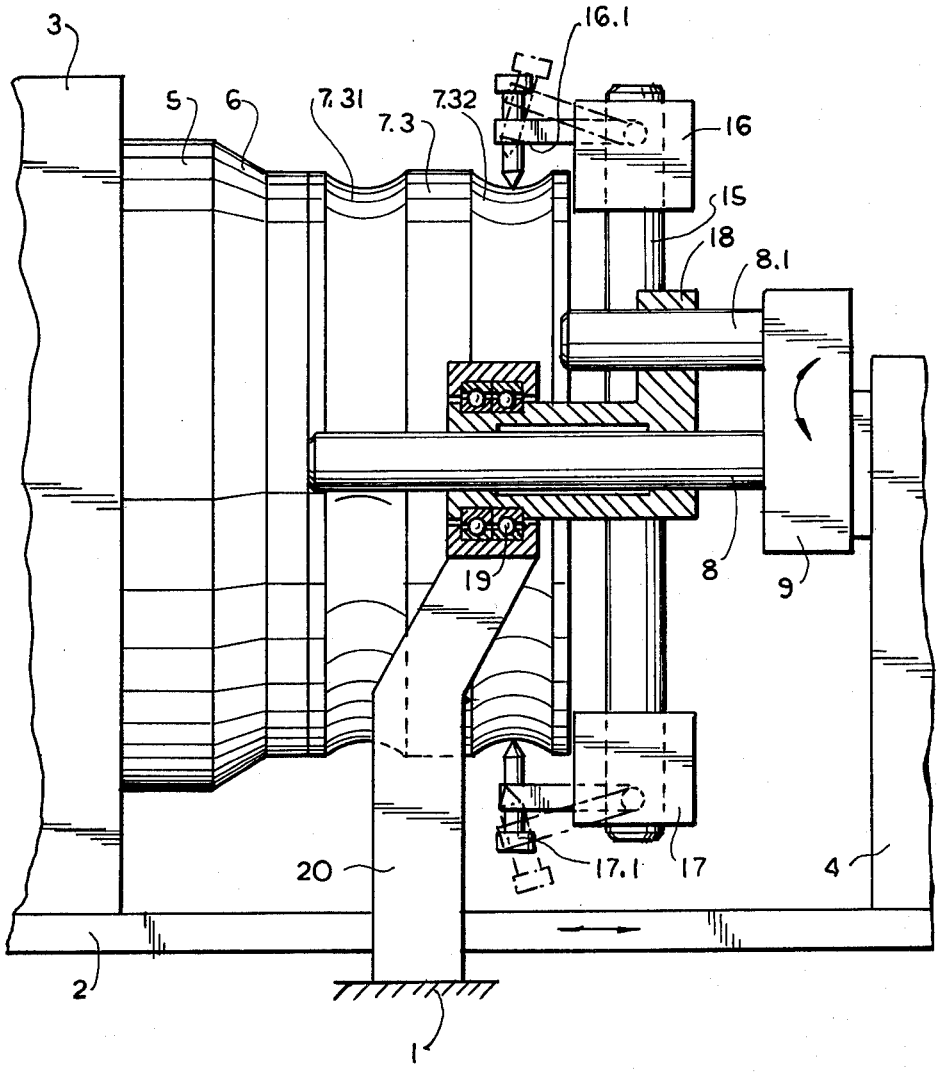
FIG. 6 illustrates a front view of an arrangement with an additional shifting member and a swivel joint for workpieces with two recessed tracks.

A longitudinally positionable machining table 2, on which a workhead 3 and a workpiece shifting device 4 are affixed, is located on a machining bed 1 of a circular grinding machine. A workpiece spindle 5 with a magnetic bushing 6 is assembled in the work head 3 for receiving the workpiece to be machined in the form of a roller bearing ring 7.1 with a straight track (FIGS. 1 and 2), or a roller bearing ring 7.2. with a recessed track (FIGS. 3, 4 and 5) or a roller bearing ring 7.3 with two recessed tracks 7.31 and 7.32 (FIG. 6), which are placed in grinding position one after the other through positioning of the machine table. An axially displaceable shaft 8, on which a feeding link 9 supporting a contact 9.1 as well as a parallel shaft 8.1 is affixed (FIG. 6), is on the side of the workpiece shifting device 4 facing the workpiece head 3. A measuring head 10 with measuring keys 10.1 and 10.2 is directly connected or hinged by means of a leaf spring 11 (FIGS. 3, 4 and 5) to the feeding link 9. An adjustable mounting 12 parallel to the shaft 8 is affixed to the feeding link 9, the mounting 12 supporting a positioning piece 12.1 on the side facing the magnetic bushing. The piece 12.1 partially protrudes toward the workpiece 7.1, 7.2, 7.3. A spring 13 is affixed at the measuring head 10 which is hinged by means of the spring 11, and is situated between the head and the feeding link 9, whereby a power connection between the measuring head 10 and the feeding link 9 is established over contact 9.1 in operating position (FIG. 3). A contact 14 is affixed on the work head 3 in the measuring plane, which is activated at the shifting of a workpiece 7.2 in order to prevent disconnection of the measuring key by leverage on axial movement of the loading arm. FIG. 6 represents an arrangement of a measurement controlling device for the machining of workpieces 7.3 with several adjacent recessed tracks 7.31, 7.32, in which the measurement controlling device comprises two single-point measuring devices 16, 17 provided with removable keys 16.1, 17.1 and are adjustably mounted on a crosspiece 15. A displacement unit 18 with a hinged joint 19 which is fixedly connected through a support 20 to the machine bed 1 is provided on the shaft 8 and the parallel shaft 8.1.

The following advantages are obtained by using the arrangement of a measurement controlling device according to this invention in a circular grinding machine.

During workpiece shifting (FIG. 2), the measuring keys 10.1, 10.2 are lifted by a small magnitude from the track of the roller bearing ring 7.1 with straight trajectory. After removing the finished machined roller bearing ring 7.1 from the positioning piece 12.1 of the mounting 12, the positioning piece 12.1 is slid into the boring of a new roller bearing ring 7.1 to be grasped through axial movement of the shaft 8 with the feeding link 9. The subsequent swinging movement of the feeding link 9 into the machining plane brings the roller bearing ring 7.1 into operating position and the two measuring keys 10.1, 10.2 into measuring position (FIG. 1). No additional time is spent for taking the measuring head 10 in and out.

In workpiece shifting of the roller bearing rings 7.2 with recessed tracks (FIGS. 3, 4, 5) in which sufficient axial displacement of the measuring head 10 can be accomplished without difficulty due to the degree of lifting of the two measuring keys 10.1, 10.2, the measuring head 10 (FIG. 5) is affixed axially in the measuring key plane while the feeding link 9 is in non-swinging position, with the measuring head 10 touching the contact 14, and the contact 14 resting in the measuring key plane in order to prevent displacement of the measuring keys 10.1, 10.2 by leverage On axial movement of the shaft 8 which supports the feeding link 9 and the mounting 12, the two measuring keys 10.1, 10.2 remain in the measuring plane since the spring 11 acts as a hinge joint. On receipt of a new roller bearing ring 7.2 through axial movement the shaft 8 supporting the feeding link 9 and the mounting 12, the measuring head is retained by the spring 13 at the contact 14 until it returns to the arrangement the contact 9.1. When the feeding link 9 is in swinging condition, the exact axial measuring position of the two measuring keys 10.1, 10.2 is resumed (FIG. 3).

In the machining of the roller bearing rings 7.3 with two recessed tracks which are placed into operating position one after the other by the axial positioning of the machine table 2, it is advantageous to use single-point measuring heads 16, 17 with large lifting capacities for the measuring keys 16.1, 17.1 so that on axial positioning, the two edges of the roller bearing rings 7.3 do not touch. On axial positioning of the workpiece from track 7.32 to track 7.31 (FIG. 6), the two measuring keys 16.1, 17.1 are automatically lifted, the displacement unit 18 with crosspiece 15 being affixed axially onto the operating and measuring plane through the support 20 with hinge joint 19.

When the track 7.31 is placed into operating position, the two measuring keys 16.1, 17.1 are automatically placed in measuring position. At the workpiece shifting, the two measuring keys 16.1, 17.1 are automatically lifted, while the roller bearing ring 7.3 is swung into the workpiece shifting position with the aid of the feeding link 9. At the same time herein, the displacement unit 18 with the crosspiece 15 and the two single-point measuring heads 16, 17 is swung over the shaft 8 and parallel shaft 8.1. Here, the hinge joint 19 makes rotating motion possible between the displacement unit and the support 20. Further workpiece shifting is accomplished in the previously described manner.

I claim:

1. A measuring controlling device for a circular grinding machine including grinding means and workpiece retaining means for rotatably holding a workpiece to be ground thereon, comprising two measuring key devices to be located on a diametrical line extending through the central axis of the workpiece to be ground and to be brought into contact with the outer surface of the workpiece therebetween, a measuring head for supporting said two measuring key devices, said measuring head being moved relative to the axial direction of the workpiece to be ground so that the measuring key devices can contact with the entire outer surface of the workpiece, a feeding link for supporting the measuring head, a workpiece shifting device connected to the feeding link so that when the shifting device is operated, the measuring head and the feeding link are moved laterally and vertically relative to the shifting device, and a mounting connected to the feeding link, said mounting having a positioning piece at one end so that the positioning piece receives a workpiece to be ground and retains the workpiece in association with the workpiece retaining means for grinding and releases the ground workpiece therefrom, whereby the workpiece can be ground by means of the grinding means into a predetermined profile with reference to the actual profile measured by the measuring key devices.

2. A measuring controlling device according to claim 1, further comprising a shaft for connecting the feeding link and the workpiece shifting device, said shaft being connected to an end of said feeding link and said mounting being connected to the opposite end of said feeding link, said workpiece shifting device controlling the shaft so that the feeding link is moved close to and away from the shifting device and is rotated relative to the shifting device.

3. A measuring controlling device according to claim 2, further comprising two springs for connecting the measuring head to the feeding link.

* * * * *